US005977844A

United States Patent [19]

Baird

[11] Patent Number: 5,977,844

[45] Date of Patent: Nov. 2, 1999

[54] DUAL POLARIZATION WAVEGUIDE PROBE SYSTEM

[75] Inventor: Andrew Patrick Baird, Bramley, United Kingdom

[73] Assignee: Cambridge Industries Limited, United Kingdom

[21] Appl. No.: 08/913,698

[22] PCT Filed: Feb. 15, 1996

[86] PCT No.: PCT/GB96/00332

§ 371 Date: Oct. 24, 1997

§ 102(e) Date: Oct. 24, 1997

[87] PCT Pub. No.: WO96/28857

PCT Pub. Date: Sep. 19, 1996

[30] Foreign Application Priority Data

Mar. 11, 1995 [GB] United Kingdom ..... 9504986

[51] Int. Cl.[6] ..... H01P 1/161; H01P 5/12

[52] U.S. Cl. ..... 333/135; 333/21 A; 333/137

[58] Field of Search ..... 333/21 A, 125, 333/126, 135, 137; 343/756

[56] References Cited

U.S. PATENT DOCUMENTS

| | | | |
|---|---|---|---|
| 3,327,250 | 6/1967 | Sleeper, Jr. | 333/125 X |
| 4,167,715 | 9/1979 | Ohm | 333/125 |
| 5,619,173 | 4/1997 | King et al. | 333/125 |

FOREIGN PATENT DOCUMENTS

| | | |
|---|---|---|
| 2 615 038 | 11/1988 | France . |
| 54-114155 | 6/1979 | Japan . |
| 2-29001 | 1/1990 | Japan . |
| 2029001 | 1/1990 | Japan . |
| 870873 | 6/1961 | United Kingdom . |
| 2076229A | 11/1981 | United Kingdom . |
| WO 92/22938 | 12/1992 | WIPO . |

*Primary Examiner*—Paul Gensler
*Attorney, Agent, or Firm*—Myers Bigel Sibley & Sajovec

[57] ABSTRACT

A waveguide includes a waveguide body, a twist plate, and a first and second probes. The waveguide body defines a waveguide cavity therein wherein the waveguide cavity has an aperture at a first end thereof, and wherein the waveguide cavity has a waveguide axis therethrough extending from the first end to a second end. The twist plate is in the waveguide cavity at the second end of the waveguide cavity wherein the twist plate is parallel to the waveguide axis, wherein the twist plate includes a leading edge facing the aperture, and wherein the leading edge includes first and second portions with the second portion being more distant from the aperture than the first portion. The first probe is in the waveguide cavity between the aperture and the leading edge of the twist plate for receiving a first signal having a first polarization entering the aperture. The second probe is in the waveguide cavity between the first probe and the leading edge of the twist plate for receiving a second signal having a second polarization entering the aperture. Related receivers and methods are also discussed.

28 Claims, 4 Drawing Sheets

DUAL POLARIZATION WAVEGUIDE PROBE SYSTEM

FIELD OF THE INVENTION

The present invention relates to a dual polarisation waveguide probe system for use with a satellite dish for receiving signals broadcast by a satellite which include two signals orthogonally polarised in the same frequency band. In particular, the invention relates to an improved waveguide for use with a low-noise block receiver into which two probes are disposed for coupling from the waveguide desired broadcast signals to external circuitry.

BACKGROUND OF THE INVENTION

In applicant's co-pending Published International Application WO92/22938 there is disclosed a dual polarisation waveguide probe system in which a waveguide is incorporated into a low-noise block receiver in which two probes are located for receiving linearly polarised energy of both orthogonal senses. The probes are located in the same longitudinal plane on opposite sides of a single cylindrical bar reflector which reflects one sense of polarisation and passes the orthogonal signal with minimal insertion loss and then reflects the rotated orthogonal signal. The probes are spaced $\lambda/4$ from the reflector. A reflection rotator is also formed at one end of the waveguide using a thin plate which is oriented at 45° to the incident linear polarisation with a short circuit spaced approximately a quarter of a wavelength ($\lambda/4$) behind the leading edge of the plate. This plate splits the incident energy into two equal components in orthogonal planes, one component being reflected by the leading edge and the other component being reflected by the waveguide short circuit. The resultant 180° phase shift between the reflected components causes a 90° rotation in the plane of linear polarisation upon recombination so that the waveguide output signals are located in the same longitudinal plane.

The above waveguide probe system has been found to perform well for the purpose for which it was designed; to provide significant signal isolation better than 40 dBs. across the current Astra satellite bandwidth being 10.7–11.8 GHz. and across other bandwidths such as 11.7–12.2 GHz. for DBS and 12.2–12.75 GHz. However, there has been a trend to increase the frequency range transmitted by new satellite systems. In fact, the frequency bandwidth is planned to increase from 10.7–11.8 GHz. to 10.7–12.75 GHz. on the Astra system in the near future. With the aforementioned design it has hitherto been difficult to use a single LNB or waveguide to cover this wider frequency range, the frequency range being covered by two or more LNBs which are tuned to cover part of the frequency range, for example 10.7–11.8 GHz. and 11.7–12.2 GHz. The existing LNB may be frequency limited because of the bandwidth achieved by the reflection rotation of the existing design.

JP-A-02029001 discloses a waveguide system which is used to rotate and reflect a signal. One embodiment of this system uses a stepped dielectric plate, which is non-reflecting, to introduce a phase shift of 180° for one component of the signal relative to the orthogonal component. This reference discloses an alternative embodiment which uses a capacitive metal rod or a dielectric rod on the diagonal line of the waveguide cross-section instead of a stepped dielectric plate. The particular solution to this problem may require a dielectric plate or rod or a capacitive metal rod.

GB 2 076 229 discloses the use of a stepped plate in apparatus for converting circularly polarised signals in a square waveguide into linearly polarised signals. It is a modified form of septum polariser which is well known in the art, and may not relate to reflection and recombination of signals to provide an increased frequency range of operation.

FR 2 615 038 discloses a waveguide with a vane which acts as a short circuit to one of the coaxial probes. The apparatus may not provide phase rotation and recombination and may not be suitable for providing an increased frequency range of operation.

SUMMARY OF THE INVENTION

It is an object of the present invention to provide an improved dual polarisation waveguide probe system which reduces at least one of the aforementioned disadvantages.

It is a further object of the invention to provide a dual polarisation waveguide probe system which can cover all Astra satellite bandwidths in a single LNB.

It is a further object of the present invention to provide an improved dual polarisation waveguide probe system with equivalent ease of manufacture to the existing waveguide probe system.

This can be achieved by providing a reflective twist plate within the probe housing which has at least two signal reflecting edges so that at least two separate signal reflections are created. The multiple signal reflections can enable the probe system to operate over a wider frequency range with minimal deterioration in signal output.

In a preferred arrangement, this is achieved by making the reflecting twist plate stepped and by providing two steps spaced at different distances from the waveguide short circuit. The leading, reflecting, edges of the steps are orthogonal to the waveguide axis. In an alternative arrangement, the reflecting twist plate may be replaced by a three step reflecting edge or by a castellated edge such that there are multiple spaced reflecting edges. This can be achieved by casting a probe system in which the waveguide has a two or three step reflecting twist plate. Alternatively, the single reflecting edge of an existing twist plate may be drilled to a predetermined depth into the twist plate to create separate reflecting edges.

Alternatively, the reflecting edge may be provided by a continuous leading edge such as an oblique line or a curve or a series of curves.

According to a first aspect of the present invention there is provided a waveguide into which at least two orthogonally polarised signals are received for transmission therealong, said waveguide having;

a first probe extending from a wall of the waveguide into the interior of the waveguide in a first longitudinal plane, said first probe being adapted to receive a first signal polarised in said first longitudinal plane, reflector means extending from the wall of the waveguide, said reflector means located downstream of said first probe and lying in said first longitudinal plane for reflecting signals polarised in said first longitudinal plane back to said first probe and allowing signals polarised in a second plane orthogonal to said first longitudinal plane to pass along the waveguide, a second probe located downstream of said reflector means and extending from said wall of said waveguide into the interior of said waveguide and lying in said first longitudinal plane, signal reflecting and rotating means, including a short circuit at the end of the waveguide, located downstream of said second probe for receiving, rotating and reflecting a second signal polarised in said second plane back along said waveguide such that said rotated and reflected signal is polarised in said first longitudinal plane and is received by said second probe, said first and second probes having respective first and second outputs located on the outside of the waveguide, the first and second outputs lying in substantially said first longitudinal plane characterised in that said reflecting and rotating means has a leading edge oriented at an angle of 45° to said first longitudinal plane and configured to provide at least two reflecting edge portions thereon, said edge portions being spaced at different distances from said short circuit at the end of said waveguide whereby a portion of said second signal is reflected from each of said reflecting edge portions for recombination with the portion of said second signal reflected from said short circuit to provide a signal polarised in said first longitudinal plane for detection by said second probe.

Preferably, said at least two reflecting edge portions are provided by spaced steps of equal width which are generally orthogonal to the waveguide axis of the waveguide. Alternatively, the reflected edge portions are provided by three spaced reflecting edges of equal length. The edges may be of different lengths.

Conveniently, the reflecting edges are orthogonal to the waveguide axis and are spaced from the short circuit by a predetermined distance for minimising signal loss across the required bandwidth.

In yet a further modification the reflecting edge may be provided by an edge which is not orthogonal to the waveguide axis, for example an oblique edge or a curved edge.

According to another aspect of the present invention there is provided a method of receiving at least two orthogonally polarised signals in the frequency range 10.7–12.75 GHz. in a single waveguide and providing at least two outputs in a common longitudinal plane, said method comprising the steps of, providing a first probe in a first longitudinal plane in said waveguide to receive a first signal polarised in said first longitudinal plane, providing a reflector means in said waveguide parallel to and downstream from said first probe for reflecting said first signal and for allowing a second signal polarised in a second plane orthogonal to said first longitudinal plane to pass, providing a second probe in said waveguide parallel to and downstream of said reflector means, said second probe being substantially orthogonal to said second plane to allow signals polarised in said second plane to pass without being received by said second probe, providing a rotating and reflector means at the end of the waveguide downstream of said second probe with a waveguide short circuit downstream of the reflector means, for receiving said second signal and for reflecting said second signal back along said waveguide towards said second probe, said rotating and reflecting means being oriented at an angle of 45° to said first longitudinal plane, said second signal also being rotated to be polarised in said first longitudinal plane and to be received by said second probe, and taking outputs from the first and second probes on the outside of waveguide, the outputs being disposed substantially in said first longitudinal plane, characterised in that said method includes the steps of reflecting a portion of said second signal from each of said reflecting edge portions and a portion of said second signal from said short circuit at the end of said waveguide, the reflected signal portions being phase shifted so that they recombine to provide a resultant signal in said first longitudinal plane for detection by said second probe.

DESCRIPTION OF THE DRAWINGS

These and other aspects of the invention will become apparent from the following description when taken in combination with the drawings in which:

FIG. 3*a*, is a graph of a transmission loss versus frequency.

DETAILED DESCRIPTION

Figure 1:
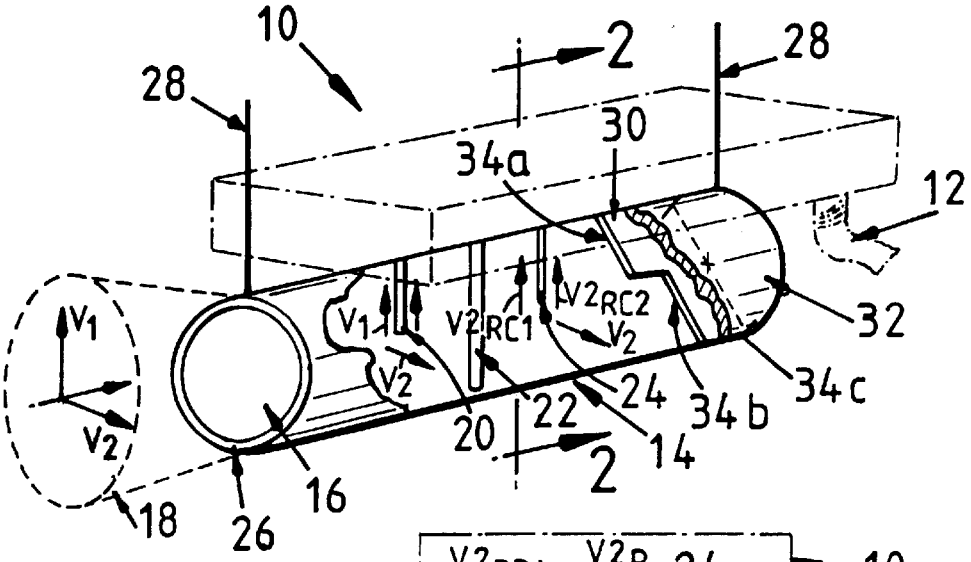
FIG. 1 is a partly broken-away view of a low-noise block receiver with a waveguide probe including a reflecting twist plate in accordance with a preferred embodiment of the present invention.

Reference is first made to FIG. 1 of the drawings in which a low-noise block receiver, generally indicated by reference numeral 10, is adapted to be mounted to a satellite receiving dish in a way which is well known in the art. As is also known, the low-noise block receiver 10 is arranged to receive high frequency radiation signals from the satellite dish and to process these signals to provide an output which is fed to a cable 12 which is, in turn, connected to a satellite receiver decoder unit (not shown in the interests of clarity).

The block receiver 10 includes a waveguide 14 which is shown partly broken away to depict the interior components. The waveguide is cylindrical and is made of metal. The waveguide has a front aperture 16 for facing a satellite dish for receiving electromagnetic radiation from a feed horn 18, shown in broken outline, which is mounted on the front of the waveguide. The waveguide is substantially the same as that disclosed in applicant's co-pending Published International Application WO92/22938. Thus, disposed within the waveguide in the same longitudinal plane is a first probe 20, a reflective post 22 and a second probe 24. In this embodiment, it will also be appreciated that the reflective post 22 does not extend the entire diameter of the interior of the waveguide for reasons disclosed in the aforementioned WO92/22938 specification. The outputs of the probes 20 and 24 pass through the waveguide wall 26 along the same longitudinal plane generally indicated by reference numeral 28. The probes 20,24 are of the same length so that the outputs lie along the same longitudinal axis within the longitudinal plane 28. The distance between the probe 20 and reflective post 22 and probe 24 and reflective post 22 is nominally $\lambda/4$ where $\lambda$ is the wavelength of the signals in the waveguide.

Figure 2:
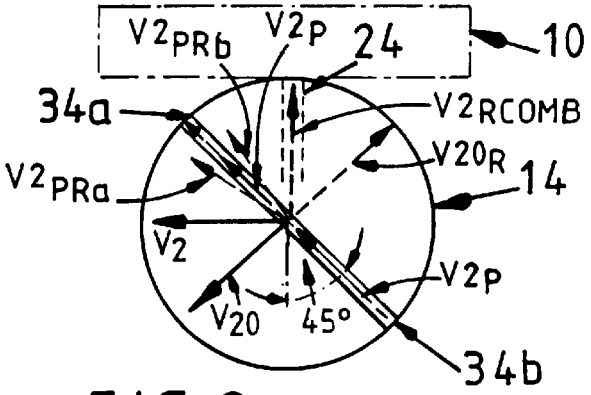
FIG. 2 is a cross-sectional view of the waveguide taken on section 2—2 of FIG. 1.

At the downstream end of the waveguide which is the furthest end from the front aperture, there is disposed within the waveguide a reflecting and rotating or twist plate 30. As best seen in FIG. 2 the reflecting and rotating plate is oriented at an angle of 45° to the probes 20,24 and post 22.

The furthest end of the plate terminates in wall 32 which acts as a short circuit which will be later explained in detail.

It will be seen that the reflecting plate is thin and has a leading edge formed of two step edges 34*a,b* of equal length and about the same thickness. The step edges 34*a,b* are orthogonal to the waveguide axis. Step 34*a* is further from the short circuit 32 than step 34*b*. With this arrangement it will be appreciated that there are two reflective edges at the leading end of the reflecting plate spaced by different amounts from wall 32.

In operation, signals from a satellite dish enter the waveguide 14 via the horn 18 and aperture 16 and in accordance with known principles are transmitted along the waveguide 14. The signals which are broadcast by the satellite include two sets of signals which are orthogonally polarised in the same frequency band and these are represented by vectors V1 and V2 which are signals polarised in the vertical and horizontal planes respectively. As the signals travel along the waveguide the vertically polarised signal V1 is received by the first probe 20 which, as it is spaced by $\lambda/4$ from the reflecting post 22, ensures the maximum field at the probe and hence optimum coupling to the probe. The probe 20 has no effect on the horizontally polarised signal V2 which continues to pass along the waveguide.

As the reflecting post is vertically oriented the signal V2 is not reflected by the post and continues to pass along the waveguide 14 and also passes the second probe 24 for the same reason. As the horizontally polarised signal V2 passes along the waveguide it encounters step edge 34*a,b*, of the thin metal twist plate 30 which is about 1–1.5 mm. thick. When the horizontally polarised signal V2 encounters the plate 30, one component $\mathbf{V2}_p$ of the signal parallel to the plate encounters edges 34*a,b*; a first portion of the component is reflected by edge 34*a* and a second portion is reflected by edge 34*b*. The orthogonal component to $V_{2P}$, $V_{20}$, is reflected by the short circuit 32 at the rear of the plate and is rotated by 180° shown as vector $\mathbf{V20}_R$ in broken outline in FIG. 2. The distance of step 34*a* from short circuit 32 corresponds to a quarter of a wavelength ($\lambda_1/4$) of a first frequency ($f_1$) near the lower end of the Astra frequency band and the distance of the step 34*b* from short circuit 32*b* corresponds to wavelength ($\lambda_2/4$) of frequency $f_2$ at the upper end of the frequency band. The signals reflected from edges 34*a*,34*b* are out of phase and are represented by phase shifted vector $\mathbf{V2}_{PRa}$, $\mathbf{V2}_{PRb}$. The reflected signal ($V_{2OR}$) is recombined with the short circuit reflected signals to create a recombined vector $\mathbf{V2}_{RCOMB}$, shown in broken outline, in the plane of probes 20,24. The reflected and recombined signal indicated by vector $V_{2RCOMB}$ then travels towards probe 24 in the longitudinal plane which is received by probe 24 and conducted to the probe output. Probe 24 is spaced from post 22 by a quarter of a wavelength which ensures maximum field at the probe and hence optimum coupling.

With this arrangement it will be understood that the total signal received at probe 24 consists of a combination of reflected and rotated signals and because the signal components from edges 34*a*,34*b* are not in-phase, the amplitudes on recombination may be less, in some cases, than the amplitude for a single straight reflecting edge as in the prior art. The reduction in signal amplitude is not significant. However, the isolation provided by this waveguide with the stepped reflecting twist plate is not substantially different to that disclosed in the applicant's aforementioned publication WO92/22938.

With this arrangement it will be appreciated that for different frequencies of transmitted signal the spacing between the various steps and short circuit corresponds more closely to particular wavelengths. Thus the waveguide is tunable by selecting the distance of step 34*a* at a distance $\lambda/4$ from the short circuit 32 where $\lambda$ corresponds to a frequency at the lower end of the frequency range, for example 11.0 GHz. and step 34*b* is set at a distance to correspond to wavelengths at a higher frequency, for example 12.2 GHz. Such a bandwidth in a single waveguide was not possible with the aforementioned prior art waveguide and reflecting twist plate because of the single distance of the leading edge from the short circuit corresponding to a quarter wavelength at a single frequency. Thus, the stepped arrangement disclosed in FIGS. 1 and 2 allows the low-noise block to be used to receive a wider range of frequencies; the bandwidth of the detector is substantially increased. There is, however, some loss in signal amplitude but in practice this has been found to be quite acceptable for this application.

Figure 3A:
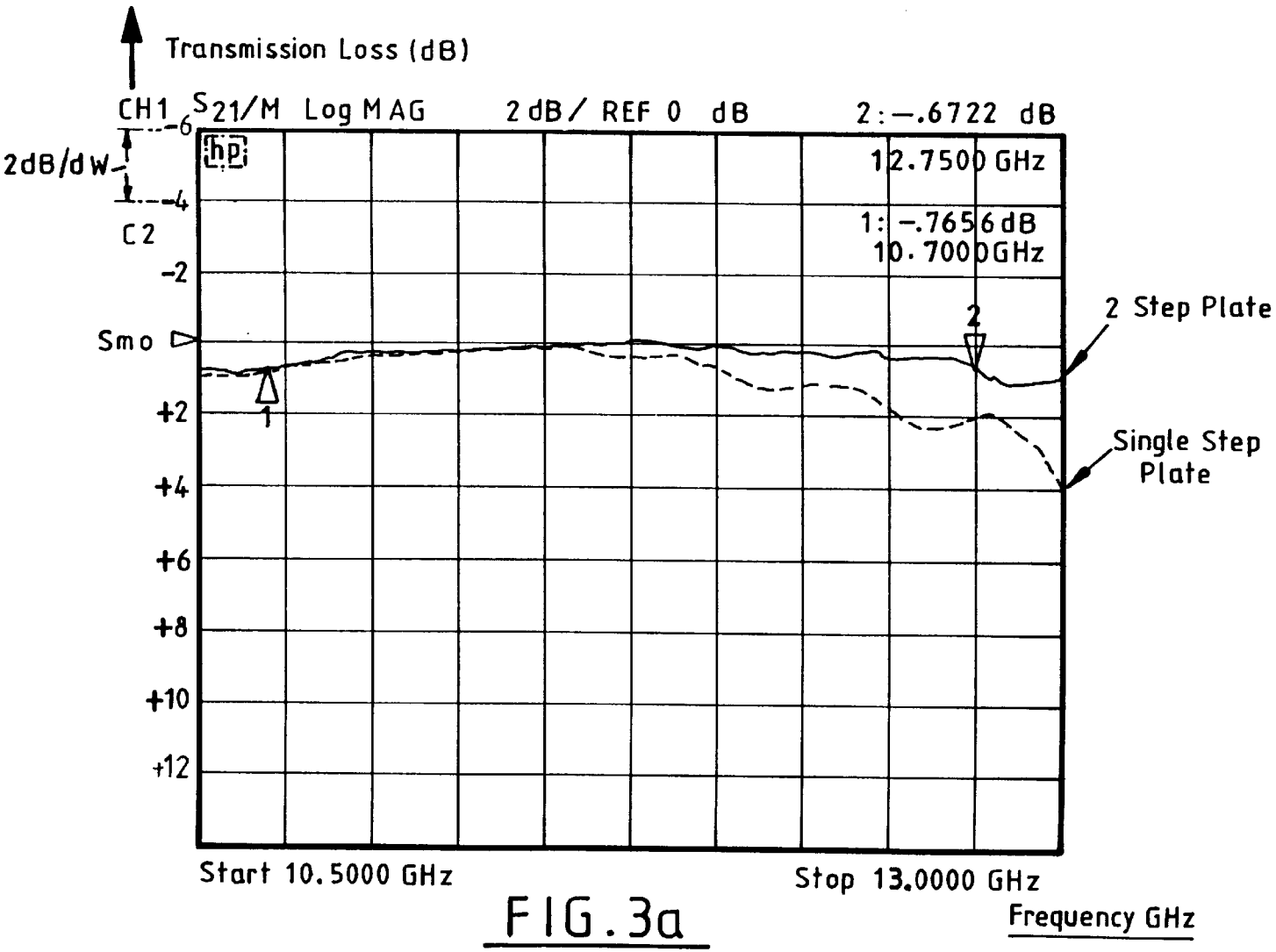
FIGS. 3*a, b* and *c* are graphs comparing the responses of a twist plate with a single reflecting surface and with two reflecting surfaces where

Reference is now made to FIGS. 3*a,b,c* which compare the response of a waveguide with a single edge reflector as in the prior art with a waveguide having the two step reflector plate shown in FIGS. 1 and 2. The two step plate is 18.5 mm wide (the width of the waveguide 14) and the first step 34*a* is 15.1 mm from the short circuit 32 and the second step 34*b* is 7 mm from the short circuit. The length of each step is 9.25 mm and the plate 30 is approximately 1 mm thick.

FIG. 3*a* shows transmission loss (dB.) with frequency with the graphs showing the limits of the new Astra band 10.7 and 12.75 GHz. respectively. It will be seen that the response of the single reflector falls off as it approaches the lower and, more particularly, the upper band limits. The loss of about 2 dB. at the high end is unacceptable. In contrast, it will be seen that the loss with the two step plate is much less than 1 dB. and there is also minimum transmission loss at the centre frequency.

Figure 3B:
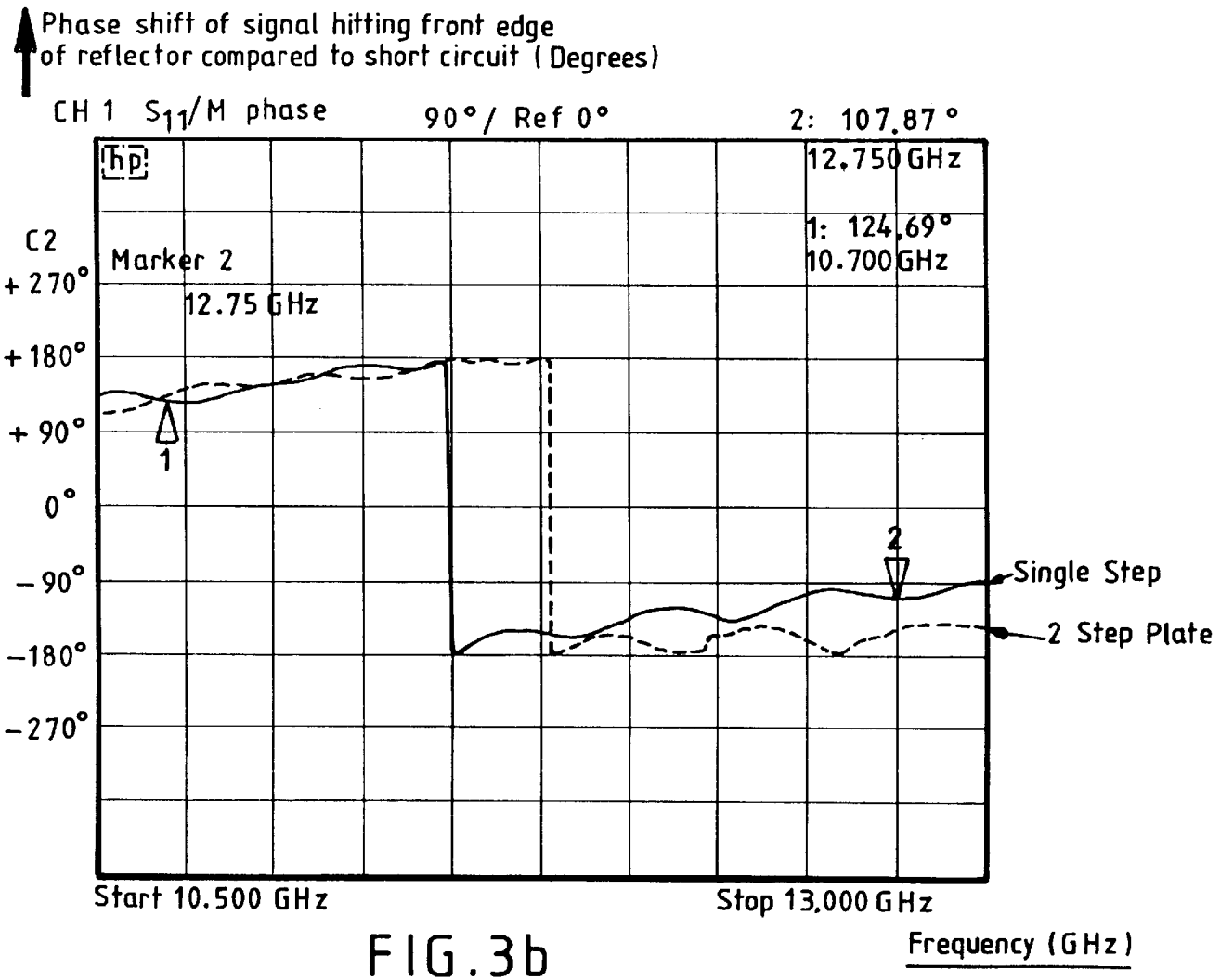
FIG. 3*b* is a graph of phase shift of the signal hitting the leading edge of the twist plate compared to the short circuit versus frequency.

Similarly, FIG. 3*b* shows that the phase shift deviation from 180° for the two step plate above the mid-range is less than with the single step plate which means that more signal is recombined with the correct phase shift across the frequency range.

Figure 3C:
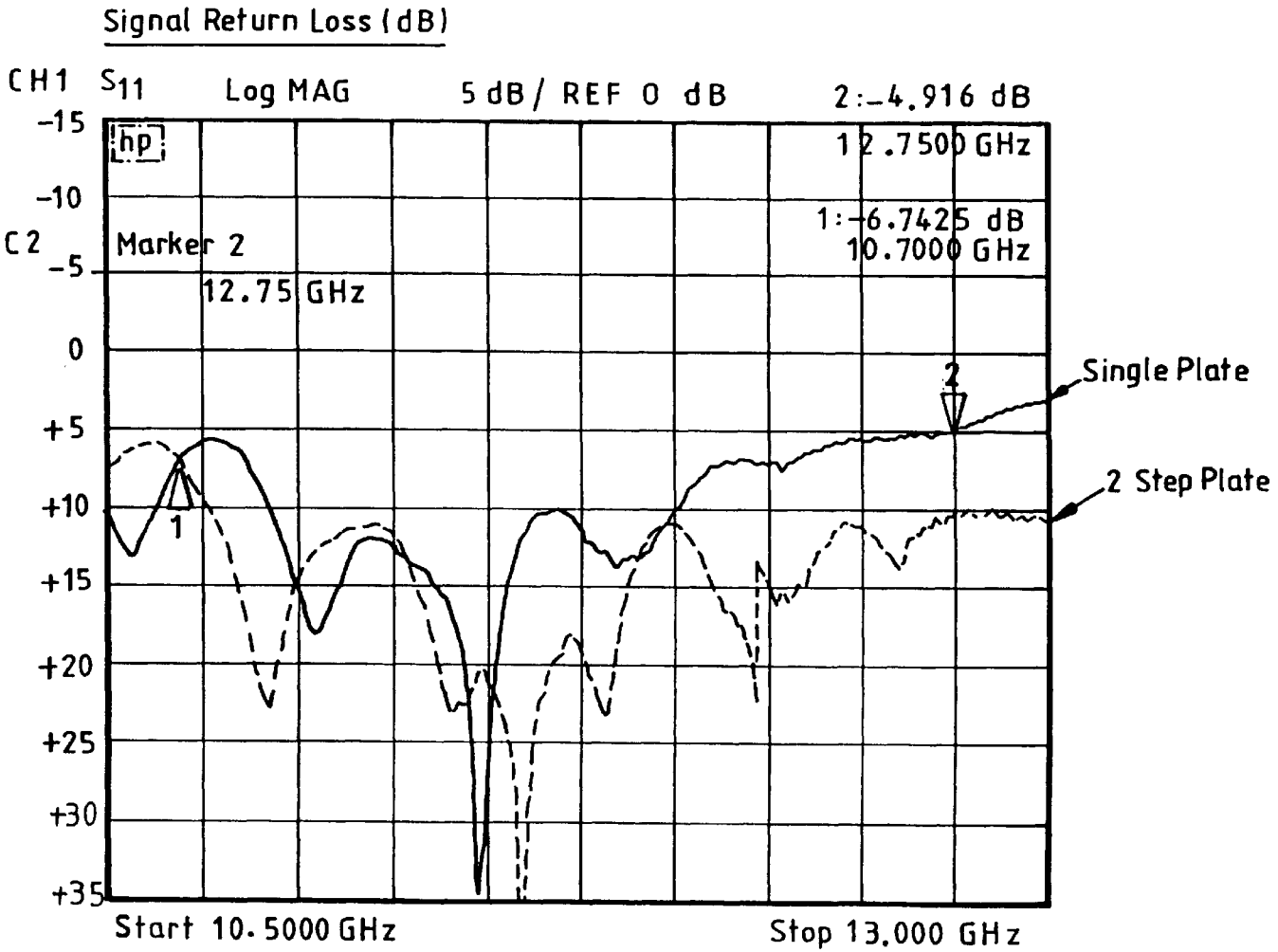
FIG. 3*c* is a graph of signal return loss in dB. versus frequency.

FIG. 3*c* is a graph of signal return loss (dB.) versus frequency which shows that the minimal signal loss occurs at the single frequency with a single plate, that is, the frequency corresponding to the $\lambda/4$ distance of the edge from the short circuit. In contrast the response from the two step plate shows that minimal signals occur at a different frequency and that there is a broader band of frequency for minimal return loss which at the upper end of the frequency range shows at least a 5 dB. improvement over the single plate reflector.

Figure 4:
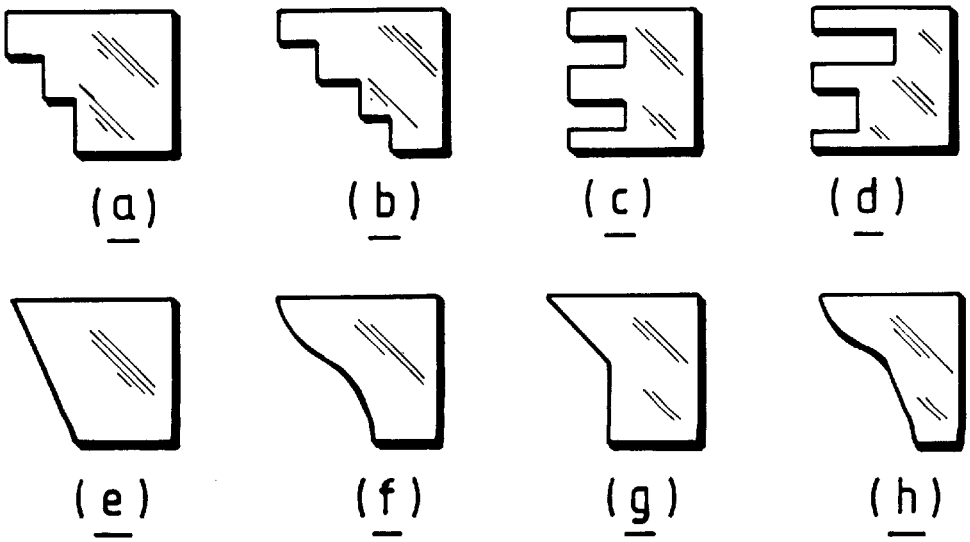
FIGS. 4*a* to *h* are side views of reflecting twist plates with multiple reflecting surfaces in accordance with alternative embodiments of the invention.

Reference is now made to FIGS. 4*a* to *h* of the drawings which depict side views of alternative designs of reflector twist plates. It will be seen that a twist plate with three steps may be used as shown in FIG. 5*a*, or four steps as shown in FIG. 4*b*. In addition, it will be appreciated that variable reflecting edges may be created by machining out the twist plate to form an E-type profile as shown in FIG. 4*c*. This E-type profile may be modified by a deeper recess as shown in FIG. 4*d*. It will also be understood that reflecting surfaces need not be orthogonal to the waveguide axis. The leading edge may be provide by an oblique edge as shown in FIG. 4*e* or a curved edge as shown in FIG. 4*f*. The reflecting edges may be a combination of orthogonal or oblique edges or curves as shown in FIGS. 4*g* and 4*h*. In another embodiment the reflective post can also extend across the entire waveguide; the waveguide operating satisfactorily with this structure.

It will be appreciated that the principal advantage of the present invention is that the reflecting plate allows the LNB to be used across a much greater bandwidth than the aforementioned prior art LNB. Consequently, a single LNB may be used to detect signals across all of the presently useable satellite bandwidths between 10.7 and 12.75 GHz. A further advantage of this arrangement is that it can use existing manufacturing techniques and involves the selection of an appropriate plate for casting into the waveguide. The technique would be applicable to bandwidth improvement at other frequency ranges outside the Astra range.

An improved dual polarization waveguide probe system has thus been discussed including a reflective twist plate 30 within a probe housing 14 and which has at least at least two signal reflecting edges 34*a* and 34*b* so that at least two separate signal reflections are created. The multiple signal reflections enable the probe system to operate over a wider frequency range with reduced deterioration in signal output. In a preferred arrangement, this can be achieved by making the reflecting twist plate stepped and by providing two steps 34*a* and 34*b* spaced at different distances from the waveguide short circuit 32. The leading, reflecting, edges of the steps 34*a* and 34*b* are orthogonal to the waveguide axis.

That which is claimed is:

1. A waveguide into which at least two orthogonally polarised signals are received for transmission therealong, said waveguide comprising:

a first probe extending from a wall of the waveguide into the interior of the waveguide in a first longitudinal plane, said first probe being adapted to receive a first signal polarised in said first longitudinal plane;

reflector means extending from the wall of the waveguide, said reflector means located downstream of said first probe and lying in said first longitudinal plane for reflecting signals polarised in said first longitudinal plane back to said first probe and allowing signals polarised in a second plane orthogonal to said first longitudinal plane to pass along the waveguide;

a second probe located downstream of said reflector means and extending from said wall of said waveguide into the interior of said waveguide and lying in said first longitudinal plane; and signal reflecting and rotating means, including a short circuit at the end of the waveguide, located downstream of said second probe for receiving, rotating and reflecting a second signal polarised in said second plane back along said waveguide such that said rotated and reflected signal is polarised in said first longitudinal plane and is received by said second probe;

said first and second probes having respective first and second outputs located on the outside of the waveguide, the first and second outputs lying in substantially said first longitudinal plane wherein said reflecting and rotating means has a leading edge oriented at an angle of 45° to said first longitudinal plane and configured to provide at least two reflecting edge portions thereon, said edge portions being spaced at different distances from said short circuit at the end of said waveguide whereby a portion of said second signal is reflected from each of said reflecting edge portions for recombination with the portion of said second signal reflected from said short circuit to provide a signal polarised in said first longitudinal plane for detection by said second probe.

2. A waveguide as claimed in claim 1 wherein said at least two reflecting edge portions are provided by spaced steps of equal width which are generally orthogonal to the waveguide axis of the waveguide.

3. A waveguide as claimed in claim 1 wherein the reflecting edge portions are provided by three spaced reflecting edges of equal length.

4. A waveguide as claimed in claim 1 wherein the edge portions are of different lengths.

5. A waveguide as claimed in claim 1 wherein the reflecting edge portions are orthogonal to the waveguide axis and are spaced from the short circuit by a predetermined distance for minimising signal loss across the required bandwidth.

6. A waveguide as claimed in claim 1 wherein at least one reflecting edge portion is provided by an edge which is not orthogonal to the waveguide axis.

7. A method of receiving at least two orthogonally polarised signals in the frequency range 10.7 GHz to 12.75 GHz in a single waveguide and providing at least two outputs in a common longitudinal plane, said method comprising the steps of;

providing a first probe in a first longitudinal plane in said waveguide to receive a first signal polarised in said first longitudinal plane;

providing a reflector means in said waveguide parallel to and downstream from said first probe for reflecting said first signal and for allowing a second signal polarised in a second plane orthogonal to said first longitudinal plane to pass;

providing a second probe in said waveguide parallel to and downstream of said reflector means, said second probe being substantially orthogonal to said second plane to allow signals polarised in said second plane to pass without being received by said second probe;

providing a rotating and reflector means at the end of the waveguide downstream of said second probe with a waveguide short circuit downstream of the reflector means, for receiving said second signal and for reflecting said second signal back along said waveguide towards said second probe, said rotating and reflecting means being oriented at an angle of 45° to said first longitudinal plane, said second signal also being rotated to be polarised in said first longitudinal plane and to be received by said second probe;

and taking outputs from the first and second probes on the outside of waveguide, the outputs being disposed substantially in said first longitudinal plane; and reflecting a portion of said second signal from said rotating and reflector means and a portion of said second signal from said short circuit at the end of said waveguide, the reflected signal portions being phase shifted so that they recombine to provide a resultant signal in said first longitudinal plane for detection by said second probe.

8. A waveguide comprising:

a waveguide body defining a waveguide cavity therein wherein said waveguide cavity has an aperture at a first end thereof, and wherein said waveguide cavity has a waveguide axis therethrough extending from said first end to a second end;

a twist plate in said waveguide cavity at said second end of said waveguide cavity wherein said twist plate is parallel to said waveguide axis, wherein said twist plate includes a leading edge facing said aperture, and wherein said leading edge includes first and second portions with said second portion being more distant from said aperture than said first portion;

a first probe in said waveguide cavity between said aperture and said leading edge of said twist plate for receiving a first signal having a first polarization entering said aperture; and a second probe in said waveguide cavity between said first probe and said leading edge of said twist plate for receiving a second signal having a second polarization entering said aperture.

9. A waveguide according to claim 8 further comprising a short circuit at said second end of said waveguide cavity wherein said short circuit is adjacent said twist plate opposite said aperture.

10. A waveguide according to claim 8 further comprising a reflective post in said waveguide cavity between said first and second probes, wherein said first and second probes and said reflective post lie in a common longitudinal plane, and wherein said leading edge of said twist plate lies in a second plane oriented at a 45 degree angle with respect to said common longitudinal plane.

11. A waveguide according to claim 8 further comprising a reflector between said first and second probes wherein said reflector reflects electromagnetic radiation having said first polarization.

12. A waveguide according to claim 11 wherein said reflector comprises a reflective post, wherein said first and second probes and said reflective post lie in a common longitudinal plane, wherein said first polarization is aligned in said longitudinal plane, and wherein said second polarization is parallel to said longitudinal plane.

13. A waveguide according to claim 8 wherein each of said first and second portions of said leading edge of said twist plate are orthogonal with respect to said waveguide axis.

14. A waveguide according to claim 9 wherein said waveguide is adapted to receive signals over a range of frequencies between a low frequency and a high frequency, wherein said first portion of said leading edge is spaced from said short circuit by a distance of one quarter of a wavelength of said low frequency, and wherein said second portion is spaced from said short circuit by a distance of one quarter of a wavelength of said high frequency.

15. A waveguide according to claim 14 wherein said low frequency is approximately 10.7 GHz and wherein said high frequency is approximately 12.75 GHz.

16. A waveguide according to claim 8 wherein said leading edge of said twist plate further includes a third portion between said first and second portions wherein said third portion is not orthogonal with respect to said waveguide axis.

17. A waveguide according to claim 8 further comprising an electrical coupling between said first and second probes and an electrical cable outside said waveguide cavity.

18. A receiver comprising:

a wave guide including, a waveguide body defining a waveguide cavity therein wherein said waveguide cavity has an aperture at a first end thereof, and wherein said waveguide cavity has a waveguide axis therethrough extending from said first end to a second end, a twist plate in said waveguide cavity at said second end of said waveguide cavity wherein said twist plate is parallel to said waveguide axis, wherein said twist plate includes a leading edge facing said aperture, and wherein said leading edge includes first and second portions with said second portion being more distant from said aperture than said first portion, a first probe in said waveguide cavity between said aperture and said leading edge of said twist plate for receiving a first signal having a first polarization entering said aperture, and a second probe in said waveguide cavity between said first probe and said leading edge of said twist plate for receiving a second signal having a second polarization entering said aperture; and a decoder electrically coupled to said first and second probes.

19. A receiver according to claim 18 wherein said waveguide further includes a short circuit at said second end of said waveguide cavity wherein said short circuit is adjacent said twist plate opposite said aperture.

20. A receiver according to claim 18 wherein said waveguide further includes a reflective post in said waveguide cavity between said first and second probes, wherein said first and second probes and said reflective post lie in a common longitudinal plane, and wherein said leading edge of said twist plate lies in a second plane oriented at a 45 degree angle with respect to said common longitudinal plane.

21. A receiver according to claim 18 wherein said waveguide further includes a reflector between said first and second probes and wherein said reflector reflects electromagnetic radiation having said first polarization.

22. A receiver according to claim 21 wherein said reflector comprises a reflective post, wherein said first and second probes and said reflective post lie in a common longitudinal plane, wherein said first polarization is aligned in said longitudinal plane, and wherein said second polarization is parallel to said longitudinal plane.

23. A receiver according to claim 18 wherein each of said first and second portions of said leading edge of said twist plate are orthogonal with respect to said waveguide axis.

24. A receiver according to claim 19 wherein said waveguide is adapted to receive signals over a range of frequencies between a low frequency and a high frequency, wherein said first portion of said leading edge is spaced from said short circuit by a distance of one quarter of a wavelength of said low frequency, and wherein said second portion is spaced from said short circuit by a distance of one quarter of a wavelength of said high frequency.

25. A receiver according to claim 24 wherein said low frequency is approximately 10.7 GHz and wherein said high frequency is approximately 12.75 GHz.

26. A receiver according to claim 18 wherein said leading edge of said twist plate further includes a third portion between said first and second portions wherein said third portion is not orthogonal with respect to said waveguide axis.

27. A receiver according to claim 18 further comprising a receiving dish oriented to reflect electromagnetic radiation toward said aperture of said waveguide cavity.

28. A receiver according to claim 27 wherein said receiving dish is adapted to reflect electromagnetic radiation transmitted by a satellite.

* * * * *